US005765400A

United States Patent [19]

Roell

[11] Patent Number: 5,765,400

[45] Date of Patent: Jun. 16, 1998

[54] METHOD OF MANUFACTURING A CONTINUOUS TUBULAR KNIT ON A FLAT-KNITTING MACHINE WITH AT LEAST TWO ACTIVE NEEDLE BEDS

[75] Inventor: Friedrich Roell, Buberach, Germany

[73] Assignee: Technit-Technische Textilien und Systeme GmbH, Germany

[21] Appl. No.: 587,230

[22] Filed: Jan. 16, 1996

Related U.S. Application Data

[63] Continuation-in-part of Ser. No. 544,142, Oct. 17, 1995, Pat. No. 5,623,840, and Ser. No. 544,141, Oct. 17, 1995, Pat. No. 5,615,562, which is a continuation-in-part of Ser. No. 416,921, Apr. 4, 1995, abandoned, which is a continuation of Ser. No. 89,112, Jul. 8, 1993, abandoned, which is a continuation-in-part of Ser. No. 370,441, Jan. 9, 1995, abandoned, which is a continuation-in-part of Ser. No. 89,112.

[30] Foreign Application Priority Data

Jul. 8, 1992 [CH] Switzerland ..... 02149/92

[51] Int. Cl.[6] ..... D04B 1/00

[52] U.S. Cl. ..... 66/190; 66/61

[58] Field of Search ..... 66/61, 190

[56] References Cited

U.S. PATENT DOCUMENTS

| | | | |
|---|---|---|---|
| 782,480 | 2/1905 | Benndorf | 66/61 |
| 5,299,435 | 4/1994 | Whalley | 66/190 X |

FOREIGN PATENT DOCUMENTS

| | | | |
|---|---|---|---|
| 153900 | 2/1982 | Germany | 66/61 |
| 26249 | of 1905 | United Kingdom | 66/61 |
| 296926 | 9/1928 | United Kingdom | 66/61 |

*Primary Examiner*—John J. Calvert

*Attorney, Agent, or Firm*—Ostrolenk, Faber, Gerb & Soffen, LLP

[57] ABSTRACT

The present invention relates to a method for the production of endless tubular fabrics on a flatbed knitting machine. Two methods are described in which the tube is knitted in one case with vertical axis and in another case with horizontal axis. In the first case, tubes of any desired length can be produced. In the second case, tubes of any desired diameter can be produced. In the first method, a first half of the circumference of the tube is knitted on a front needle bed, whereupon the second half of the circumference is knitted on the rear needle bed upon the backward movement of the cam carriage of the flatbed knitting machine. Thereupon, the second course of loops is knitted on the first needle bed and knitted backward in the second needle bed. In this way an endless tube is knitted. The tube is stabilized in circumferential direction by the laying-in of a filling thread. In the other method, the first course is knitted as connected multi-layer knitted fabric on the front and rear needle beds. The following courses are knitted separately on the front and rear needle beds, and, in the last course, the separately knitted courses are again connected as connected two-layer course, so that the tube is closed. The tube is stabilized in circumferential direction by warp threads.

12 Claims, 12 Drawing Sheets

METHOD OF MANUFACTURING A CONTINUOUS TUBULAR KNIT ON A FLAT-KNITTING MACHINE WITH AT LEAST TWO ACTIVE NEEDLE BEDS

CROSS-REFERENCE TO RELATED APPLICATIONS

This is a continuation-in-part of application Ser. No. 08/544,142 filed on Oct. 17, 1995, now U.S. Pat. No. 5,623,840, which is a continuation-in-part of application Ser. No. 08/370,441 filed on Jan. 9, 1995, now abandoned, which is a continuation-in-part of application Ser. No. 08/089,112 filed on Jul. 8, 1993, now abandoned. Also, this is a continuation-in-part of application Ser. No. 08/544,141 filed on Oct. 17, 1995, now U.S. Pat. No. 5,615,562, which is a continuation-in-part of application Ser. No. 08/416,921 filed on Apr. 4, 1995, now abandoned, which is a continuation of application Ser. No. 08/089,112 filed on Jul. 8, 1993, now abandoned.

The present invention relates to a process for the production of an endless tubular knit fabric on a flatbed knitting machine which has at least two active needle beds.

It has been customary up to now to knit endless tubular knitted fabrics on a circular knitting machine. This has the disadvantage that the diameter of the tube is fixed by the circular knitting machine. In other words, only a tube having a diameter defined by the circular knitting machine can be knitted on the machine.

The object of the present invention is therefore to provide a method for knitting an endless tubular knitted fabric which permits the production of tubes of different diameter and in which the flexibility of the knitted tube in circumferential direction is stabilized.

Another object of the invention is to provide a method of producing an endless knitted fabric in which the tube produced is stabilized not only in circumferential direction but also in axial direction.

Still another object of the invention is to provide an endless tubular knitted fabric which is produced by the method described in the claims and is stabilized in circumferential direction.

A further object of the invention is to provide an endless tubular knitted fabric which in addition to being stabilized in circumferential direction is also stabilized in the axial direction of the resultant tube.

BRIEF SUMMARY OF THE INVENTION

In accordance with one aspect of the invention, the diameter of the tube is fixed by the selection of the active region on the needle beds of a flatbed knitting machine. The tube is knitted in the manner that half of the circumference of the tube is knitted on the one needle bed and the other half of the circumference of the tube on the other needle bed. The diameter of the tube is determined by the selection of the active region on the needle beds, i.e. the larger the active region, the larger the diameter of the tube.

The tube is produced in the following manner:

The first half of the circumference of the tube is knitted on the first needle bed from a starting point up to a specific end point which is determined by the diameter desired for the tube. Upon the knitting, a filling thread is laid in the loops of the first needle bed or bound to the loops. The second half of the circumference of the tube is then knitted on the second needle bed back from the end point to the starting point, whereby a course of the tube will be knitted. Upon the backward knitting, the same filling thread is laid in the loops of the second needle bed or bound to them. The same process is now repeated in connection with the following courses until a desired axial length of the tube has been reached. The filling thread which is bound to the knitted fabric imparts the tube increased stability in circumferential direction.

The laying-in of the filling thread can be effected in the following ways:

Either two auxiliary needle beds are provided onto which loops can be transferred at predefined distances apart from the front and rear needle beds. The filling thread is then laid between the loops on the auxiliary needle bed and the active needle bed. Thereupon, the loops are transferred back from the auxiliary needle beds to the active beds, the filling thread being bound between the loops. In this way the loops of the active needle bed hold the filling thread fast towards the outside, while the transferred loops on the inside of the tube hold the filling thread fast towards the inside. Every second, third or fourth loop can be transferred. How great the distance is selected between the loops to be transferred depends, in the final analysis, only on how strong the binding of the filling thread into the knitted fabric is to be. If a very good stabilizing of the tubular knitted fabric in circumferential direction is to be obtained, then it is advantageous to transfer in each case every second loop so that the filling thread is always bound alternately by a loop conducted past in front of it and behind it. In addition to this binding, there is also the possibility of binding the filling thread to the loops in some other manner. Thus, for instance, the filling thread can be placed in tuck at defined distances apart or be looped together with the loops of the knitted fabric.

In accordance with another aspect of the invention, it is also possible to knit a two-layer tube with the use of four active needle beds. On the two front needle beds, i.e. the front outer needle bed and the front inner needle bed, the outer and inner layers of the first half of the circumference of the tube are knitted. On the two rear needle beds, i.e. the outer rear and inner rear needle beds, the two layers of the second half of the circumference of the tube are knitted. The binding together of the two layers is effected in the manner that loops are transferred alternately between the inner and outer needle beds, or two-surface knitting is effected, for instance rib knitting. In this way, the filling thread is also bound between the loops of the inner and outer needle beds.

In accordance with another aspect of the invention, the binding between the two layers can also be effected in the manner that a pile thread is bound at well-defined distances apart to the two layers of the tubular knitted fabric. The binding of the pile thread to the two layers is effected in the manner that the pile thread is placed in tuck at defined distances apart in the case of both layers, or in the manner that at defined distances apart, the pile thread is looped together with the loops of the two layers. In the case of this double-layer tubular knitted fabric in which the two layers, i.e. the inner and outer layers of the knitted fabric, are bound together by pile threads, there are various possibilities for the stabilizing of the circumference of the tube by means of a filling thread. The filling thread can, for instance, be laid between the layers in a defined position with respect to the pile thread. In this case, the filling thread is simply laid between the inner and outer needle beds. Alternatively, for the stabilizing of the circumference, the filling thread can also be bound with one of the two layers or with both layers in the manner that it is placed in tuck with the loops of the corresponding layer or is looped together with them.

The knitting of the two-layer fabric is effected in a manner similar to that which has already been described in connection with the production of a single-layer tubular knitted fabric. On the two inner needle beds, i.e. on the front and rear inner needle beds, the inner layer of the tube is knitted while on the outer two needle beds, i.e. the outer front and outer rear needle beds, the outer layer is knitted.

The tube can now be knitted in the manner that first of all both layers are knitted on the two front needle beds from the starting point up to an end point which determines the diameter of the tube. Thereupon, the two layers are knitted back from the end point to the starting point on the rear needle beds, i.e. the second half of the circumference of the tube, whereby a two-layer course of the tube would be knitted. Alternative knitting methods are also conceivable in which first of all the outer layer is knitted, i.e. on the front outer needle bed from the starting point to the end point and on the rear outer needle bed from the end point back to the starting point, and thereupon the inner layer is knitted on the front inner needle bed from the starting point to the end point, and then the second half of the circumference of the inner layer on the rear inner needle bed back from the end point to the starting point, in which connection the two-layer course would then be knitted. This knitting of a course is repeated until a desired axial length of the tube is obtained.

In the method for the production of circumference-stabilized tubular knitted fabrics described above, it is possible also to obtain an axial stabilization of the knitted fabric in the manner that, at given needle spacings, i.e. at a distance apart of a few loops, warp threads are introduced into the knitted fabric, these warp threads being then connected, with a given axial spacing, i.e. the spacing of a few wales, with the loops of the knitted fabric. The warp thread can also be connected in various ways to the knitted fabric. In the case of a double-layer knitted fabric, the warp thread can, for instance, be fastened between the two layers. In this case, it is introduced between the inner and outer needle beds. The warp thread can also be placed in tuck at given distances apart or be looped together with loops of one layer or both layers. In this way, the warp threads can also at least in part assume the function of an axially extending pile thread.

Even though, in the above aspects of the invention, certain solutions have been described as alternatives, it is obvious to the person skilled in the art that different solutions can be combined with each other should this not be out of the question for technical reasons.

While all of the methods described above describe the production of a tube in connection with which one half of the circumference of the tube has been knitted on the front needle beds and the other half of the circumference of the tube on the rear needle beds, i.e. the axis of the tube extends vertically, there will now be described methods in which a tube is produced in the manner that its axis extends horizontally. In the following methods, the axial length of the tube, rather than the diameter of the tube, is determined by the region of the active needles on the needle beds. This, to be sure, limits the possible axial length of the tube to the width of the flatbed knitting machine, but it makes it possible to produce tubes of a diameter of any desired size while, in the methods described above, the maximum diameter of the tube was determined by the width of the flatbed knitting machine but the axial length could be any desired, based on the number of courses.

In accordance with another new aspect of the invention, a tube is now produced in the manner that a two-layer knitted fabric with the layers connected together is knitted on the front and rear needle beds of the knitting machine. Upon the following courses, the knitted fabrics which were connected together in the first course are now knitted further separately on the two needle beds. Upon the last course, the loops of the front and rear needle beds are again connected to each other by a connected two-layer knitting technique. For the stabilizing of the circumference of the tube produced in this manner, warp threads are introduced, both on the front needle bed and on the rear needle bed, with defined needle spacings, which warp threads are connected together at the upper and lower ends after the complete knitting of the tube. These warp threads are connected to the knitted fabric by known techniques. As connection techniques there is suitable the binding of the warp threads in the manner that the warp threads are guided once in front of and once behind the loops of the knitted fabric. Other possibilities for binding in the knitted fabric are the placing in tuck and the looping to the loops of the knitted fabric.

With this method also, it is possible to produce a double-layer knitted fabric. In such case, a flatbed knitting machine having four needle beds is required. It should be made clear in this connection that three-layer knitted fabrics can also be knitted with the use of six-bed flat knitting machines. The number of possible layers is in this connection limited only by the maximum number of needle beds in a flatbed knitting machine. The knitting of multiple-layer tubes will now be described by way of example on a two-layer tube on a four-bed machine. On the outer two needle beds, the outer layer of the tube is knitted and on the inner two needle beds the inner layer of the tube. In the first course, a connected double-layer course is knitted with the outer needle beds. Thereupon, upon return to the two inner needle beds, a connected double-layer knitted course is knitted. The layers are then knitted further separately from each other on the rear and front needle beds, in which connection the layers knitted on the two front needle beds are connected with each other at defined distances apart, in exactly the same way as the two layers on the two rear needle beds. The separate knitting can be effected in different ways. Due to the guiding of the looping thread, it will be preferable if alternately the loops are knitted forward and back on the front two needle beds and on the rear two needle beds. For this purpose, the cam carriage can, upon the forward movement, knit a first course on the two front needle beds and then, upon the backward travel, knit another course on the front needle beds. In the same way, upon the forward travel of the cam carriage, knitting can be effected only on the outer needle beds, while upon the return travel of the cam carriage, knitting is effected on the inner needle beds. As an alternative, it is possible for the cam carriage to knit on both front needle beds upon forward travel and on both rear needle beds upon rearward travel. Thereupon, upon the forward knitting on both rear needle beds and upon the backward travel on both front needle beds. It is important in the case of these alternative knitting methods only that the thread guide for the looping thread be moved alternately back and forth by the cam carriage. Of course, it is possible in this connection to bind a filling thread in for the axial stabilizing of the tube or to connect it to the loops of the knitted fabric. In the next-to-the-last course, the loops of the inner layer of the tube are again alternately connected together on the two inner needle beds and in the last course the loops of the outer tubular layer are connected together on the two outer needle beds, whereby a closed tube is obtained. The warp threads which travel along upon the knitting are then connected to each other by known techniques of connection, such as knotting, gluing, welding or sewing.

Since endless tubular knitted fabrics produced by the method of the invention which are stabilized in circumferential direction by filling or warp threads are not yet known, a further aspect of the invention is the creation of endless tubular knitted fabrics the circumference which is stabilized in accordance with one of the above-mentioned methods either by filling threads or by warp threads. Another aspect of the invention consists therein that these endless tubular knitted fabrics of stabilized circumference are furthermore stabilized in axial direction by warp or filling threads.

The invention will be explained below on the basis of preferred embodiments, with reference to the diagrammatic drawing, in which.

Figure 1:
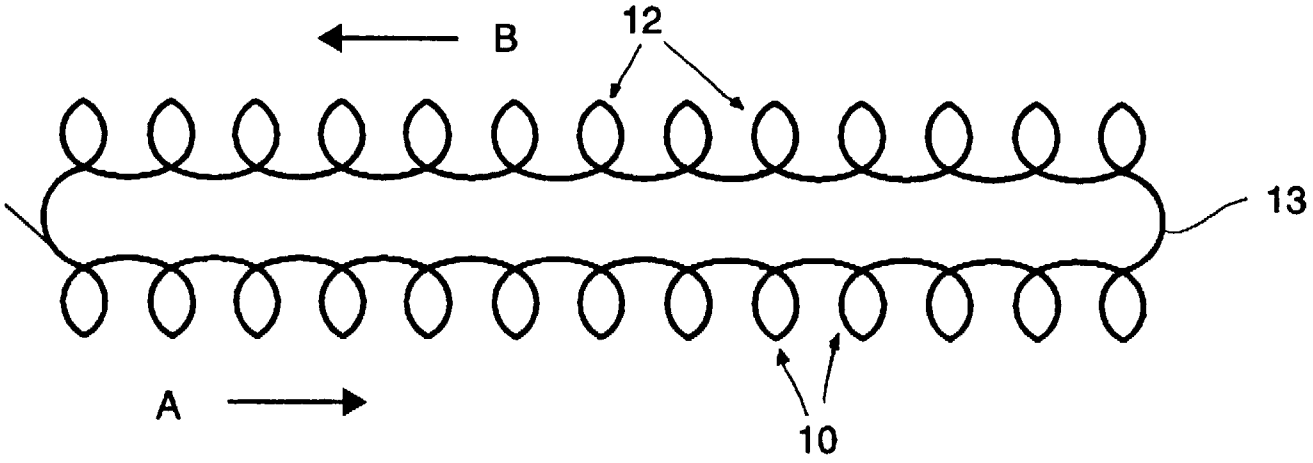
FIG. 1 shows a needle diagram of an endless tubular knitted fabric without additional filling insert.

FIG. 1 shows the needle diagram of an endless tubular knitted fabric. The loops suspended on the front needle bed are designated by the reference numeral 10. The loops suspended on the rear needle bed are designated by the reference numeral 12. Such a fabric is knitted as follows: Upon the forward movement of the cam carriage in the direction indicated by the arrow A, the loops 10 are knitted on the front needle bed. Thereupon, the connecting thread 13 is conducted to the rear needle bed where, upon the return travel of the cam carriage in the direction of the arrow B, the loops 12 are knitted. The connecting thread is then again conducted to the first needle bed and the second row of loops 10 is knitted. This process is repeated until an axial length of the knitted fabric corresponding to the number of courses has been obtained. The diameter of the tube is determined by the active region of the needles, and therefore by the number of loops in a course.

Figure 2:
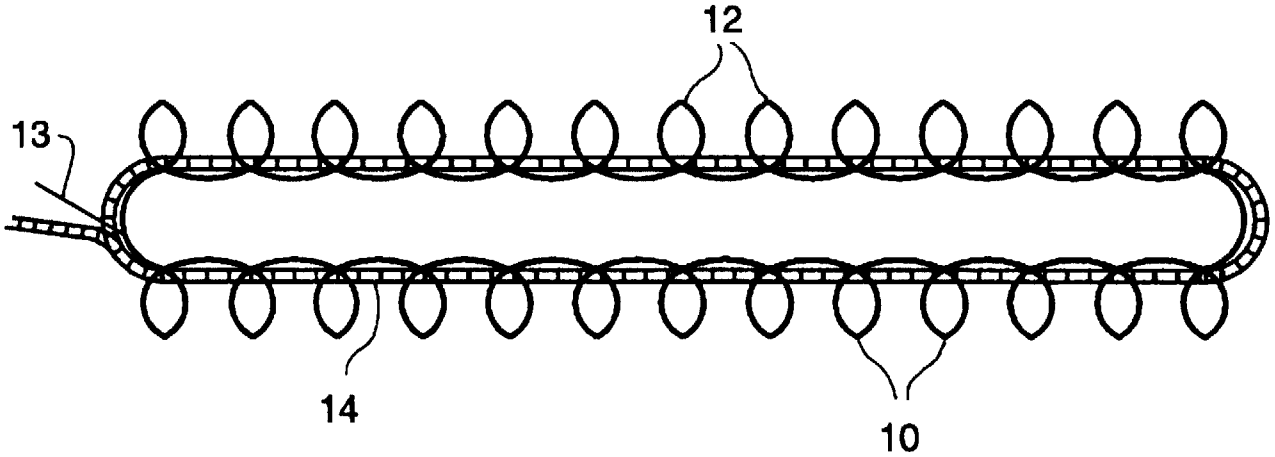
FIG. 2 shows a needle diagram of an embodiment of the invention with laid-in filling thread for the circumferential stabilizing of the tube.

FIG. 2: In order to impart greater stability in circumferential direction to the tube knitted in accordance with FIG. 1, a filling thread 14 is connected to the knitted fabric in addition to the connecting thread 13 from which the loops 10, 12 are formed. The filling thread 14 is preferably laid between the loops 10, 12. However, it can also be connected to the loops in a manner which is described below.

Figure 3:
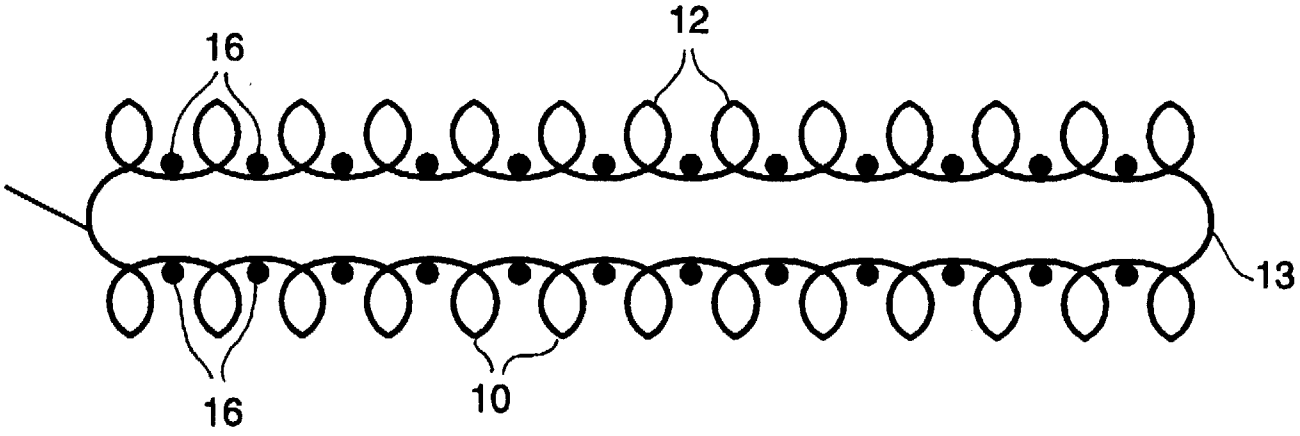
FIG. 3 shows a needle diagram in accordance with FIG. 1 with additionally introduced warp threads for the axial stabilizing of the tube.

FIG. 3 shows the same knitted fabric as FIG. 1, but in which the endless tubular knitted fabric, however, has warp threads 16 which are provided for the axial stabilizing of the tube. These warp threads 16 are introduced in the embodiment shown in FIG. 3, into the knitted fabric at a distance apart of one loop. These warp threads can, however, be introduced with larger spacings into the knitted fabric, as is shown in FIG. 4.

Figure 4:
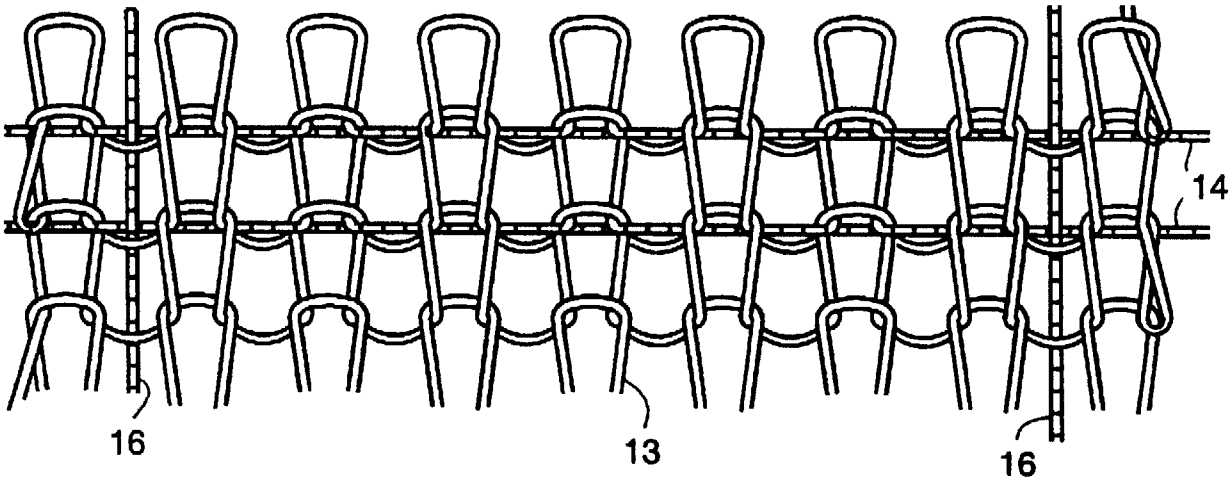
FIG. 4 shows a stitch pattern of an endless tubular knitted fabric in accordance with FIGS. 2 and 3 with inserted warp and filling threads for circumferential and axial stabilization.

FIG. 4 shows a stitch diagram of an embodiment which is obtained in the manner that the introduction of the filling thread of FIG. 2 and the introduction of the warp thread of FIG. 3 are combined with each other. The warp threads 16 are in this case arranged at a relatively large distance from each other of 11 loops. For reasons of clarity of the drawing, only two filling threads for the stabilizing of the circumference of the tube are shown. The lowermost filling thread has been omitted in order to indicate the connecting of the loops without the introduction of a filling thread. From the stitch diagram it is clear that the knitted fabric is stabilized well both in circumferential direction and in axial direction of the tube by the introduction of the filling and wrap threads.

Figure 5:
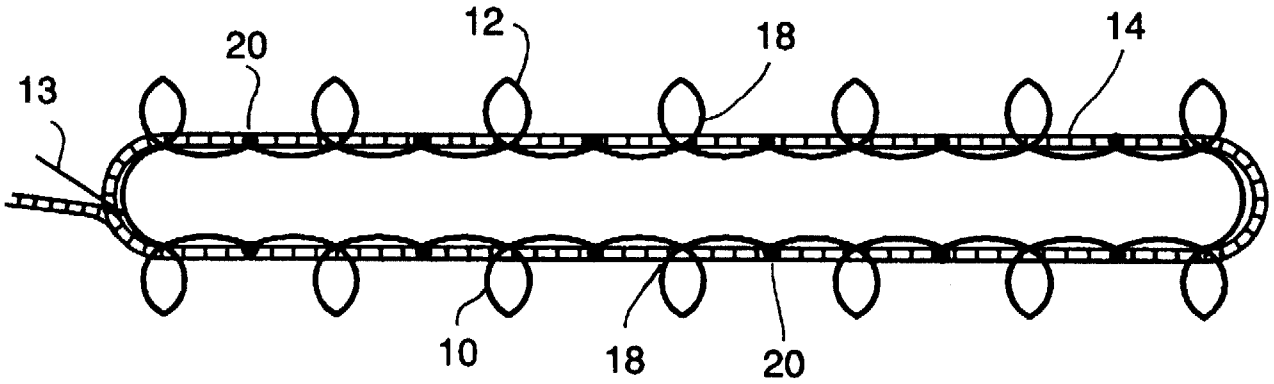
FIG. 5 is a needle diagram of anther embodiment of the invention with a filling thread which is alternately placed on tuck and looped.

FIG. 5 shows another possibility for connecting the filling thread 14 to the loops 10, 12 of the knitted fabric. At the points 18, the filling thread is either looped with the corresponding loops 10, 12 or it simply travel past the loop at these points. At points 20, the filling thread 14 is placed on tuck on the looping thread 13, which represents a further possibility for connecting the filling thread 14 to the tubular knitted fabric.

Figure 6:
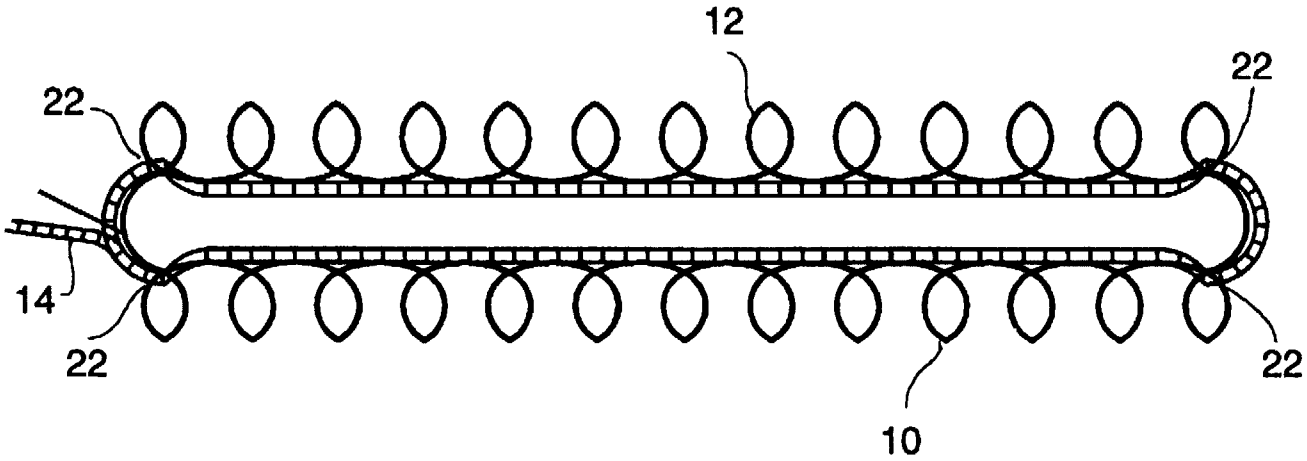
FIG. 6 is a needle diagram of another embodiment of the invention with a filling thread which is placed in tuck in four points of the knitted fabric.

In accordance with FIG. 6, the filling thread is placed in tuck in the region 22 of the first and last loops of each needle bed. This loose attachment of the filling thread to the tubular knitted fabric is suitable when only a loose connection of the filling threads to the knitted fabric is desired.

Figure 7:
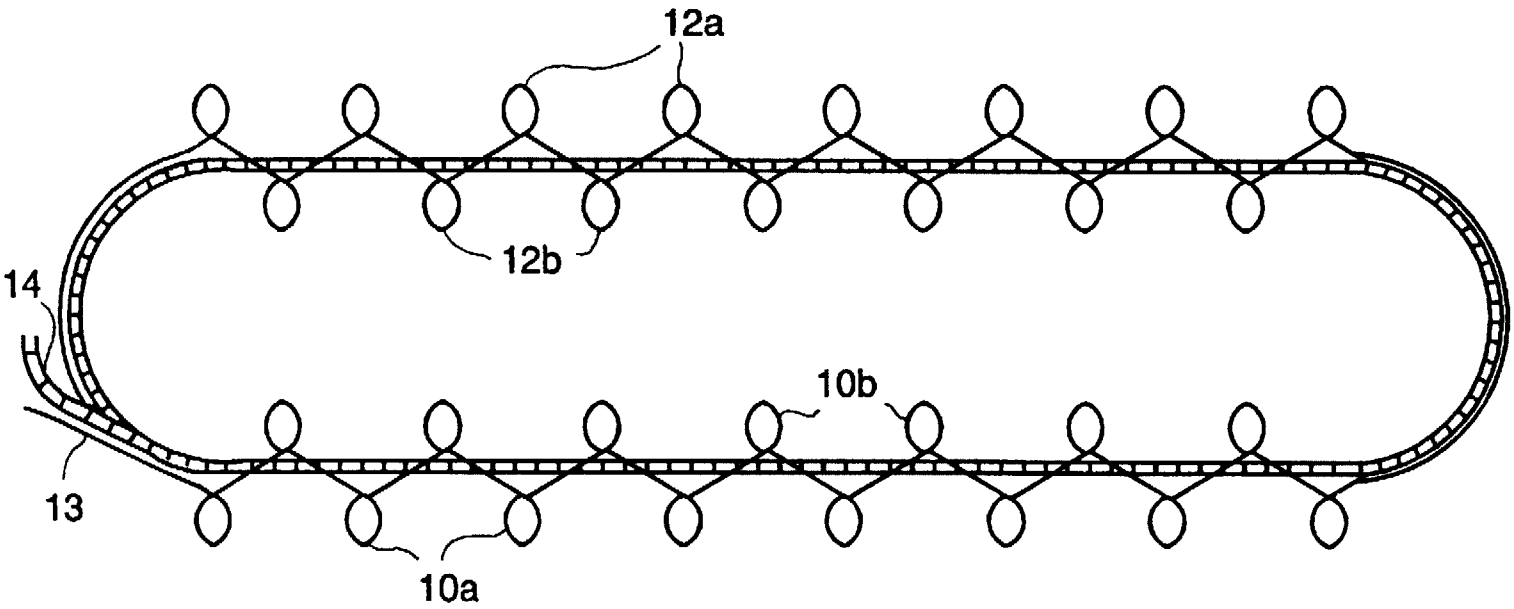
FIG. 7 is a needle diagram of a double-layer knitted fabric with filling thread laid between the layers.

FIG. 7 shows the needle diagram of a double-layer endless tubular knitted fabric. For the knitting of this tubular knitted fabric, four active needle beds are necessary. The loops 10*a* hang on the front outer needle bed. The loops 10*b* are hung on the front inner needle bed, while the loops 12*b* are present on the rear inner needle bed. The loops 12*a* are present on the rear outer needle bed. The knitting of a double-surface knitted fabric, in the present case a one-by-one rib knitted fabric, is known from the prior art and therefore need not be described in detail. In this embodiment also, a filling thread is inserted for the circumferential stabilizing of the tubular knitted fabric, said thread being laid into the knitted fabric alternately between a loop of the front needle bed and a loop of the rear needle bed.

Figure 8:
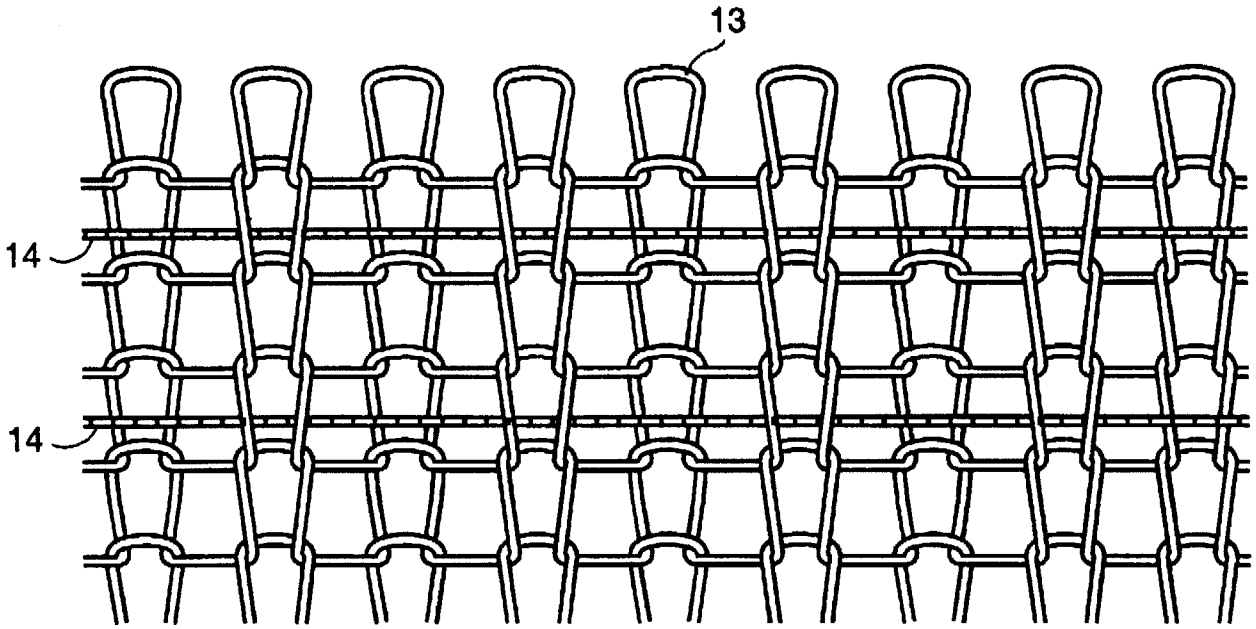
FIG. 8 is a stitch diagram of the embodiment of the invention in accordance with FIG. 7.

The stitch pattern corresponding to FIG. 7 is shown in FIG. 8. It should be emphasized here that in all figures identical parts or parts having identical functions have been designated with identical reference numerals.

Figure 9:
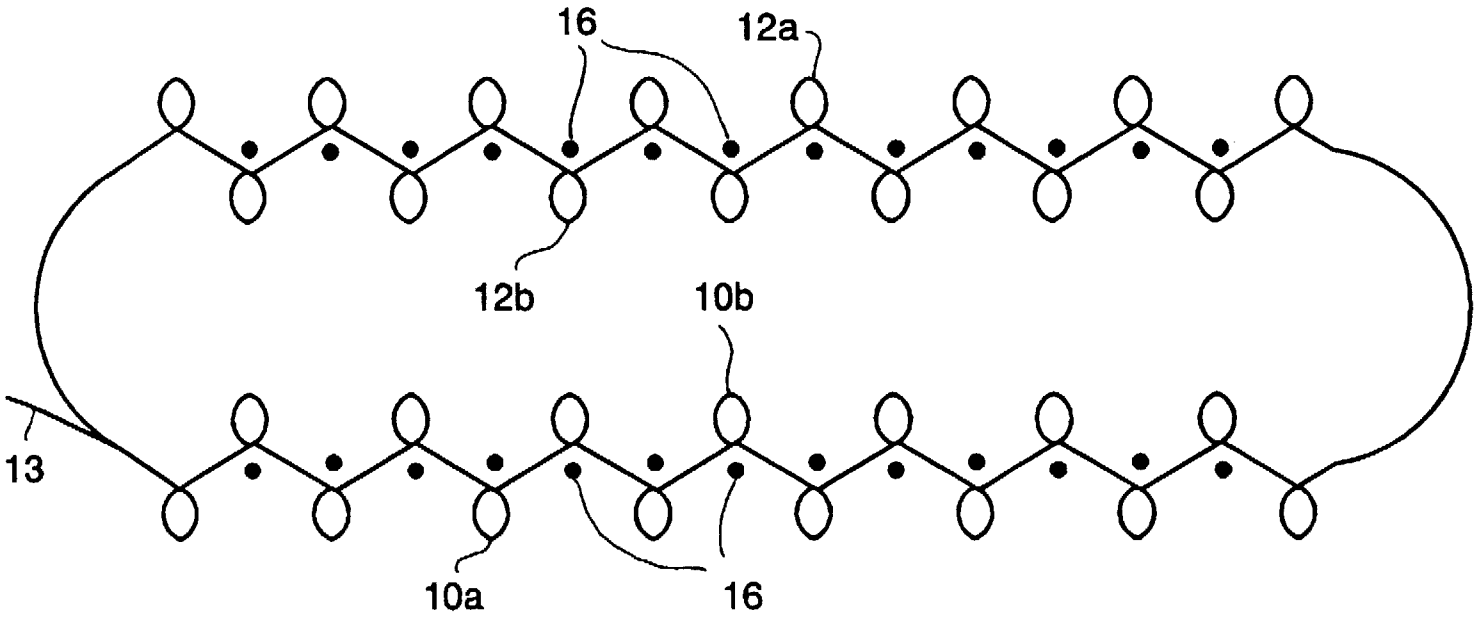
FIG. 9 is a needle diagram in accordance with FIG. 7 with warp threads introduced for the axial stabilizing of the tube.

FIG. 9 shows a needle diagram similar to FIG. 7, with the difference that instead of the filling thread 14, warp threads 16 are introduced into the knitted fabric. The warp threads are conducted in such a manner that they always extend alternately to the loops. In this way, a double-layer tubular knitted fabric of excellent axial stability is obtained.

Figure 10:
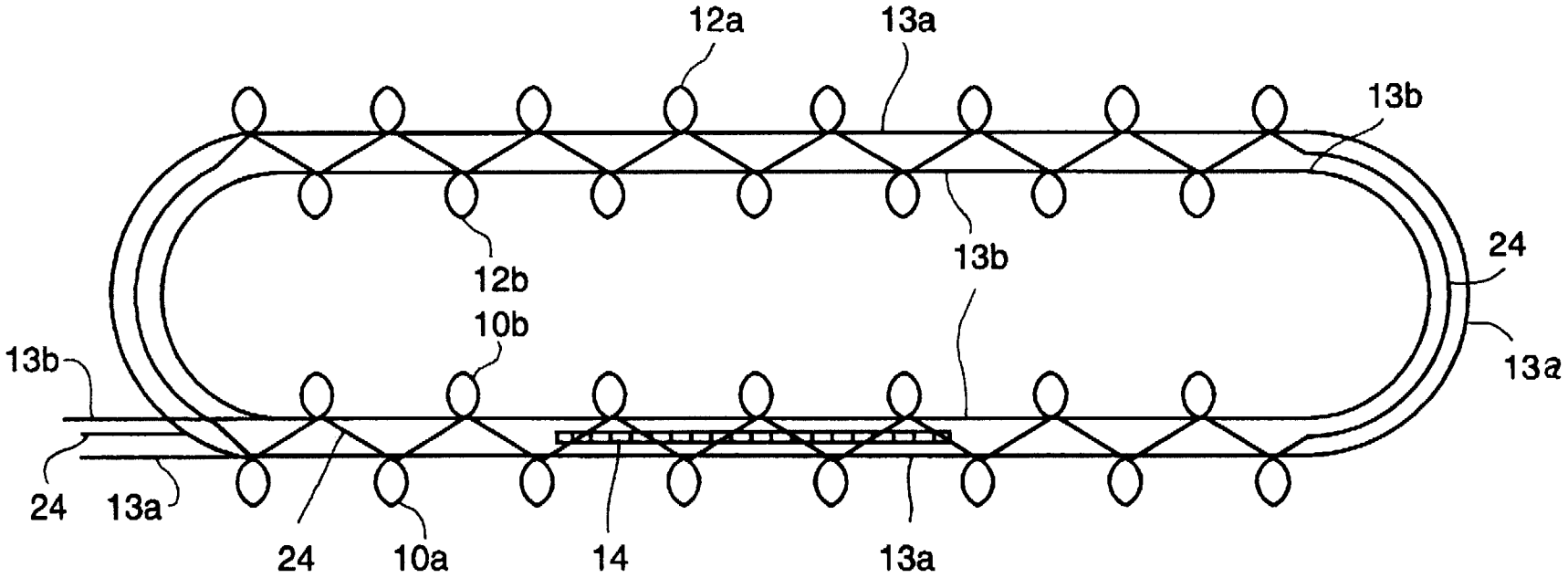
FIG. 10 is a needle diagram of a double-layer tube the layers of which are connected to each other by pile threads, both layers being stabilized by a filling thread.

While FIGS. 7 to 9 show two-layer knitted fabrics which are developed as one-by-one rib knitted fabric, FIG. 10 shows a double-layer knitted structure which is knitted with two connecting threads 13*a*, 13*b*. This is realized in the following manner: The two looping threads 13*a*, 13*b* are introduced on the front outer and inner needle beds and looped there. At the same time, a pile thread 24 is introduced which serves for connecting the loops on the outer and inner needle beds. Upon the forward movement of the cam carriage of the four-bed flat knitting machine, the loops 10*a*, 10*b* are formed on the front two needle beds by the looping threads 13*a*, 13*b*. At the same time, by means of a separate thread guide, the pile thread is introduced between said loops and connected to them. Thereupon, the thread guide for the looping threads 13*a*, 13*b* and the pile thread guide for the pile thread 24 are moved to the two rear needle beds where, upon the backward movement of the cam carriage, the loops 12*a* and 12*b* are knitted, again connected by a binding of the pile thread 24. The connecting of two knitted fabric layers by a pile thread is well known to the person skilled in the art and for reasons of clarity of the drawing is not explained further. Between the loops 10*a* and 10*b* there is shown a piece of a filling thread 14 which extends in a specific manner between the pile thread so that it is fixed by the latter. In this way, a stabilizing of the knitted fabric in circumferential direction is obtained. The filling thread 14 for reasons of clarity of the drawing has been entered only partially since, otherwise, the course of the individual looping threads and of the pile thread would no longer as be clear. It should thus be made clear that on corresponding six- or eight-bed machines, the manufacture of three- or four-layer tubular knitted fabrics respectively would be possible in a manner similar to that shown here in connection with FIG. 10. It should furthermore be made clear that the features of different embodiments of the above-described figures can definitely be combined with each other insofar as this is technically possible.

Figure 11:
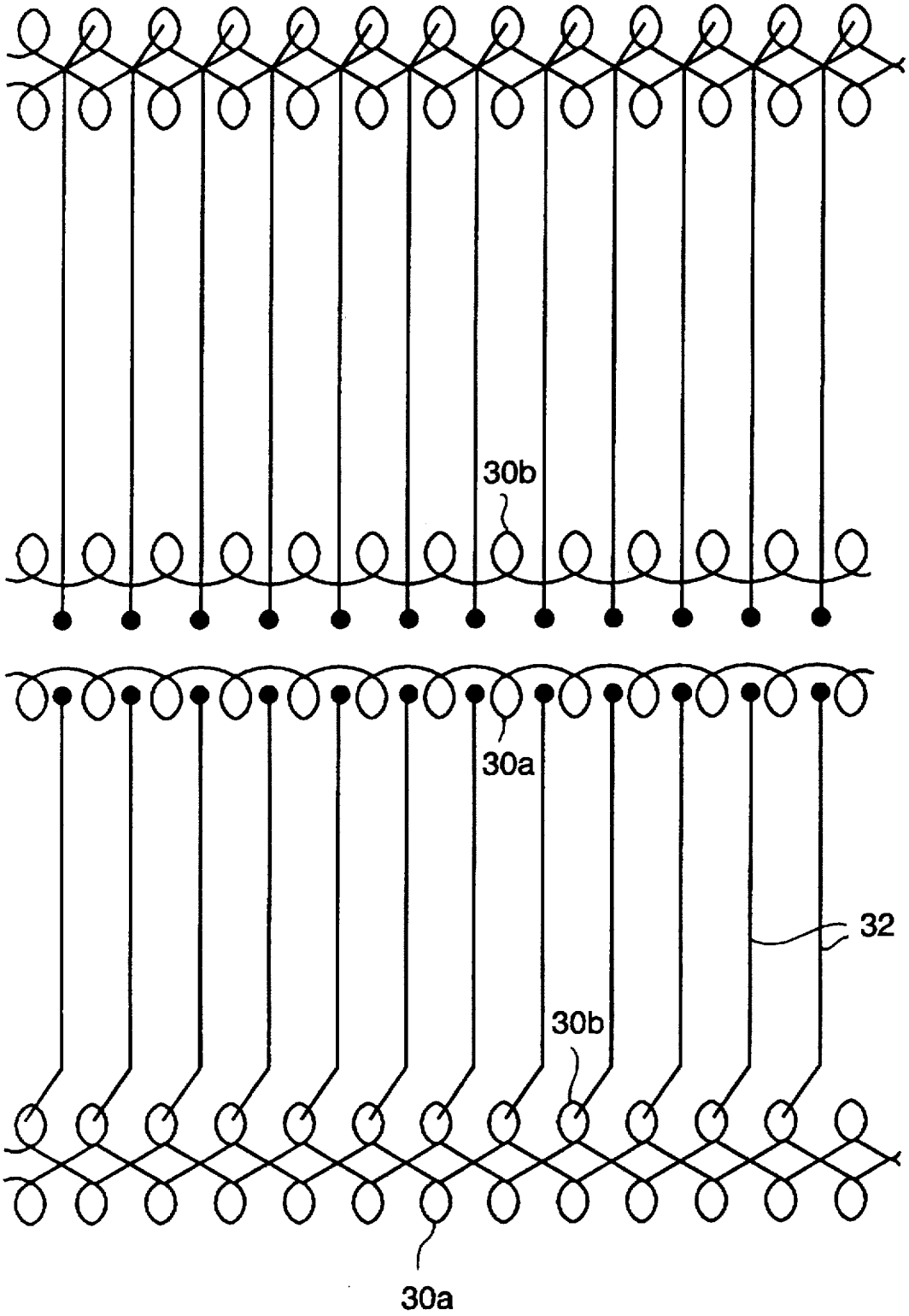
FIG. 11 is the needle diagram of the first course, an intermediate course, and the last course upon the knitting of an endless tubular knitted fabric with horizontal axis of the tube.

FIG. 11 shows the needle diagram of an endless tubular knitted fabric in which the knitting is effected in the manner that the axis of the knitted tube is horizontal upon the knitting, in contradistinction to the embodiments of the previous figures, in which the tube was knitted in a position in which the axis of the tube is vertical. At the bottom of FIG. 11 there is shown the needle diagram of the first course. This first course is knitted on two needle beds as connected two-layer knitted fabric. In the following courses, see FIG. 11 center, the loops 30*a* and the loops 30*b* are knitted separately on the front and rear needle beds. The reference numeral 32 designates warp threads which are guided along the rear loops 30*b* and are connected with them at defined distance apart. The warp threads for the front courses have been omitted in order not to obscure the drawing. The number of courses of the separately knitted front and rear loops 30*a*, 30*b* results in the size of the diameter of the tube, so that tube diameters of any desired size can be produced. The axial length of the tube, on the other hand, is limited by the width, i.e. the number of needles of the flatbed knitting machine. In the last course, see top of FIG. 11, both separately knitted layers of the loops 30*a* and 30*b* on the front and rear needle beds are again brought together as two-layer knitted fabric connected to each other, as a result of which the tube is closed. At this place, the warp threads from the rear and front needle beds are also connected to each other in a manner known to the person skilled in the art.

Figure 12:
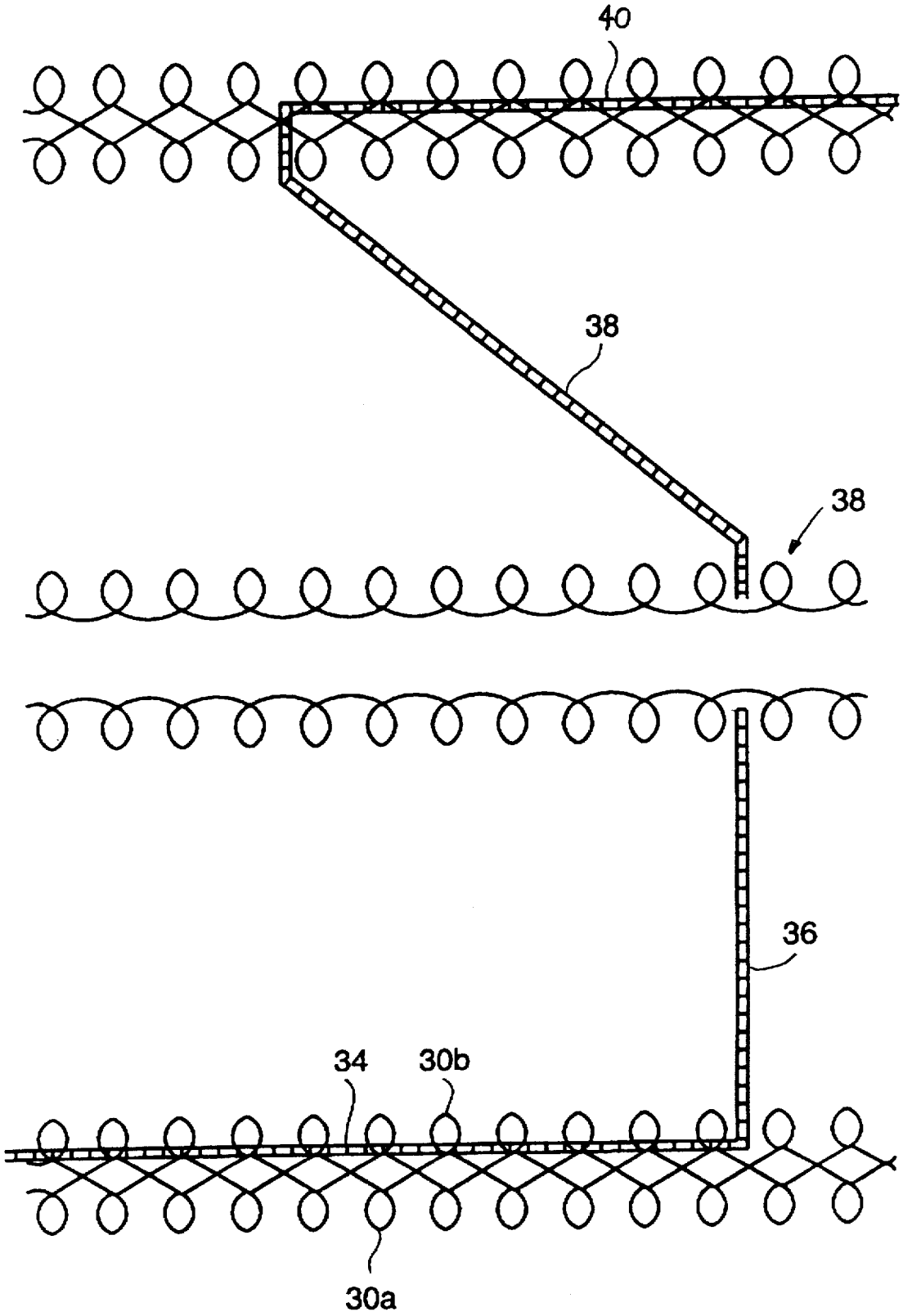
FIG. 12 is a needle diagram of the embodiment in accordance with FIG. 11, with additionally introduced filling thread which is conducted in part diagonally and in part as a warp thread.

FIG. 12 shows a needle diagram similar to FIG. 11, with the difference that there a thread 34 is conducted as filling thread up to a given loop into the loops present on the rear needle bed. Thereupon the thread is left standing, as a result of which it acts as warp thread 36 upon the knitting of further courses. As from a given course 38 in the knitted fabric, the warp thread is then conducted diagonally, so that it acts as combined warp/filling thread 38. In the last course, this thread is then again extended out of the knitted fabric as filling thread 40. It is obvious that such a defined introduction laid-in thread as filling and/or warp thread is only possible with a separate thread guide which can be controlled independently of the movement of the cam carriage over the needle bed. With such a thread guide it is possible to effect an axial or circumferential stabilization of the tube at defined places by the guiding of the thread as filling or warp thread.

The embodiments in FIGS. 11 and 12 can be knitted on a machine having four or more beds also as double-layer or multiple-layer knitted fabric. Since the needle diagram of such a knitted fabric can practically no longer be shown, a showing of the needle diagram has therefore been omitted. The method of producing a two-layer endless knitted fabric in accordance with FIG. 11 will, however, be briefly described. In the first course, a double-layer connected fabric is knitted, this being done on the two outer needle beds of the four-bed machine. This connected double-layer of the first course is the start of the outer layer of the tubular knitted fabric. In the second course thereupon, a connected two-layer knitted fabric is also knitted on the inner needle beds, it representing the start of the inner layer. In the following courses, interconnected two-layer structure is knitted on the two front needle beds, and a connected two-layer structure is knitted on the rear two needle beds, the double-layer structures being knitted separately on the front and rear needle beds. In the next-to-the-last course, the two separately knitted layers on the two inner needle beds are again connected as a two-layer connected knitted fabric and, in the last course, the two layers on the outer needle beds. The production of a double-layer tube is then complete. The warp threads for the circumferential stabilization could be introduced in suitable manner between the layers. The warp threads could also be connected with the inner layers and/or the outer layers in known manner. After the removal of the knitted fabric from the machine, the warp threads of the front and rear needle beds must still be connected with each other so that the warp threads are closed around the entire circumference of the tubular knitted fabric and thus produce a circumferential stabilization of the tubular knitted fabric.

The description of the invention in connection with the above figures is only intended to show preferred embodiment of the invention. Of course, modifications of the embodiments described are possible within the scope of protection of the appended claims. Thus, for instance, all embodiments can be knitted as multi-layer knitted fabric, in which case the flatbed knitting machine requires twice as many needle beds as there are layers in the knitted fabric. Furthermore, it is possible to combine the insertion of filling or warp threads in the tubular knitted fabric. The filling and warp threads can be so guided, for instance, also in a specific relationship to each other, for instance in the manner of a woven fabric. In this way, there is then produced a knitted fabric having a connected woven-fabric layer which stabilizes the knitted fabric both in circumferential direction and in axial direction of the tube.

Inserted threads can be connected with a knitted fabric in various ways. Thus, for instance, they can be placed in tuck or else looped. The distances between the points of connection to the knitted fabric can be selected freely in accordance with the requirements. Different techniques of connection can also be combined with each other. Similarly, several filling threads or several warp threads can be connected in different ways with the knitted fabric.

By the method of the invention and the knitted fabrics which can be produced from it, there can be produced cigarette shaping bands which can move with very high speed over small radii of deflection. The knitted fabrics are furthermore suitable for dough belts, letter-sorting belts, high-temperature belts into which silica or carbon fibers can be inserted as filling or warp threads. Heating belts, for instance for chair heating, can also be produced from correspondingly high temperature resistant fibers.

Furthermore, belts for all possible transportation and machining processes can be produced.

I claim:

1. A method of producing an endless tubular knitted fabric on a flatbed knitting machine having at least two active needle beds, comprising the following method steps:

a) determining the diameter of the tube by the selection of active regions on the needle beds;

b) knitting the first half of the circumference of the tube on the first needle bed from a starting point up to an end point defined in accordance with a);

c) upon the knitting, laying in a filling thread into the loops of the first needle bed or connecting a filling thread with the loops;

d) knitting the second half of the tube circumference on the second needle bed in backward direction from the end point to the starting point, thereby knitting a complete course of the tube;

e) upon the backward knitting, laying in the filling thread into the loops of the second needle bed or connecting a filling thread with second needle bed loops;

f) repeating steps b) to e) until a desired axial length of the tube is obtained, the filling thread which is connected with the knitted fabric imparting increased stability in circumferential direction to the tube.

2. A method according to claim 1, further comprising connecting the filling thread with the loops by being placed in tuck stitches at defined distances apart.

3. A method according to claim 1, further comprising connecting the filling thread with the loops knitting with the loops at defined distance apart.

4. A method according to claim 1, further comprising laying the filling thread into the loops in the manner that a loops of the front and rear needle bed are transferred at predetermined distances apart onto corresponding front and rear auxiliary needle beds, laying the pile thread between the loops on the active needle beds and the transferred loops on the corresponding auxiliary needle beds, and moving the transferred loops back on to the active needle bed.

5. A method according to claim 1 further comprising producing a knitted two-layer tube on four active needle beds, knitting is performed on both the front needle beds to produce two layers of the first half of the circumference of the tube and on both the rear needle beds to produce two layers of the second half of the circumference of the tube, and alternately transferring at defined distances apart, loops of the front two needle beds transferring the loops a second time and after the laying-in of the filling thread.

6. A method according to claim 1 further comprising producing a knitted two-layer tube using four active needle beds, wherein, knitting on both front needle beds, the two layers of the first half of the circumference of the tube and on both rear needle beds the second half of the circumference of the tube, introducing a pile thread for connecting the two layers together, connecting said pile thread with the two layers at defined distances apart, and inserting a filling thread between the two layers in a specified position with respect to the pile thread.

7. A method according to claim 6, further comprising tucking the pile thread at defined distances apart.

8. A method according to claim 6, further comprising looping the pile thread with the layers at defined distances apart.

9. A method according to claim 1 further comprising knitting a two-layer tube using four active needle beds, knitting the two layers of the first half of the circumference of the tube on both front needle beds and knitting the second half of the circumference of the tube on both rear needle beds, and introducing wherein a pile thread connecting together of the two layers, connecting the pile thread at defined distances apart to the two layers, and connecting at least one filling thread with at least one of the two layers for circumferential stabilizing of the tube.

10. A method according to claim 9, further comprising tucking the filling thread at defined distances apart in the at least one layer.

11. A method according to claim 9, further comprising looping the filling thread at defined distances apart with said at least one layer for the stabilizing of the.

12. A method according to claim 1, further comprising feeding warp threads of the tube to the knitted fabric for axial stabilization both needle beds at defined needle distances apart, connecting the warp threads with the knitted fabric at a defined distance apart equal to at least one wale.

* * * * *